US005988459A

United States Patent [19]

Nelson et al.

[11] Patent Number: 5,988,459

[45] Date of Patent: Nov. 23, 1999

[54] DISPENSER PACKAGE

[75] Inventors: Dave E. Nelson, Waterford; James R. Crapser, Racine, both of Wis.

[73] Assignee: S. C. Johnson & Son, Inc., Racine, Wis.

[21] Appl. No.: 08/895,408

[22] Filed: Jul. 18, 1997

[51] Int. Cl.[6] ..... B65D 47/06

[52] U.S. Cl. ..... 222/541.1; 220/359.3; 220/359.4

[58] Field of Search ..... 222/541.6, 541.9, 222/541.1; 220/359.3, 359.4

[56] References Cited

U.S. PATENT DOCUMENTS

| | | |
|---|---|---|
| 2,705,579 | 4/1955 | Mason . |
| 3,521,805 | 7/1970 | Ward . |
| 3,575,325 | 4/1971 | Leeds . |
| 3,721,360 | 3/1973 | Collie . |
| 4,974,732 | 12/1990 | Sullivan et al. . |
| 5,009,894 | 4/1991 | Hsiao . |
| 5,318,824 | 6/1994 | Itaya et al. . |

FOREIGN PATENT DOCUMENTS

| | | |
|---|---|---|
| PCT/DK95/00404 | 5/1996 | WIPO . |

*Primary Examiner*—Kenneth Bomberg

[57] ABSTRACT

A child-resistant package includes a multilayered polymeric tray having a basin and a brim. The tray has a plastic structural layer and a bonding layer. A multilayered polymeric cover has a cross-oriented, tear-resistant layer, a bonding layer, and a moisture-barrier layer between the tear-resistant layer and the bonding layer of the cover. The bonding layer of the cover is sealed to the bonding layer of the brim of the tray to form a closed cavity between the tray and the cover.

21 Claims, 4 Drawing Sheets

DISPENSER PACKAGE

FIELD OF THE INVENTION

The present invention relates to a dispenser package for containing and dispensing materials such as hazardous, corrosive, or caustic powders, and more particularly to a single-use, tear-resistant package, for such powders, which is resistant to opening by children, for example, and which can be opened by cutting across a preformed spout for pouring the contained material from the package.

BACKGROUND OF THE INVENTION

With many liquid or granular products, it is convenient or desirable to provide single-use quantities in disposable containers. These containers take many shapes and forms, depending upon the nature and use of the product contained. Such containers can be tailored for easy opening, or to facilitate dispensing of the product once opened, or both.

For example, U.S. Pat. No. 5,009,894, to Hsiao, discloses a breakable packet in which medicinal pellets are vacuum sealed. The packet has a synthetic plastic cover and a flexible backing sheet. A frangible zone extends across a neck of the packet, at which the packet is bent and broken to allow the pellets to be dispensed.

U.S. Pat. No. 3,521,805, to Ward, discloses a dispensing packet, formed from a sheet of synthetic resin material, which includes recessed pockets interconnected by a recessed neck. A sheet of covering material is sealed to a peripheral flange of the resin material to seal the packet. The packet is folded between the pockets, causing the packet to rupture at the neck to allow the contents to be dispensed.

Similarly, U.S. Pat. No. 2,705,579, to Mason, discloses a packet having compartments formed by the sealing of one flexible sheet to another. In this case, separate compartments are provided to hold, for example, salt and pepper, and each is provided with a spout extending from a corner of the packet. The packets are opened by tearing across a corner, through one of the spouts, at a scored or perforated tear-line.

U.S. Pat. No. 3,575,325, to Leeds, et al., shows a similar dispensing package having a molded blister sealed at its peripheral flange. Within the periphery of the blister, near a corner, an inward protuberance is formed by edges. The edges combine with the walls of the blister to define a pair of channels near the corner. The blister is scored or otherwise weakened near the protuberance. The blister is folded at the score to break open the package, so the contents can be poured or shaken out through the channels.

U.S. Pat. No. 4,974,732, to Sullivan, et al., shows a pouch, formed of molecularly-orientable polymeric film such as polypropylene, polyethylene, or polystyrene, sealed along a peripheral edge. The pouch defines a containment cavity and a discharge spout extending from the cavity. A seam is disposed between the cavity and the spout. The film at the discharge end of the spout is molecularly-oriented in a specific direction. This, combined with a slit and a tear-initiating notch on either side of the spout, permits the pouch to be torn open across the spout in a controlled manner.

U.S. Pat. No. 3,721,360, to Collie, discloses a container closed by heat sealing. A score line or notch allows the container to be cut or torn open. The container is constructed of a foamed polymer. This allows the container to be readily opened without deforming the material around the cut or tear.

Some products include reactive components that are best kept separate prior to use. Therefore, disposable containers are sometimes provided with separate compartments, often with parallel spouts through which the various components can be simultaneously dispensed upon opening.

Published International Application WO 96/12660, to Josephsen, et al., discloses a package for at least two mutually reactive photographic chemicals. An outer membrane delimits a chamber, which is divided into compartments by at least one partition wall. The partition wall extends into a neck, which is designed to be opened by a single cut along a cutting line, opening both compartments.

With certain corrosive products, it is important that the container be resistant to the corrosive action of the product itself. In addition, with hazardous products, it is important that the container be resistant to such external corrosive influences as air, light or moisture, as well.

U.S. Pat. No. 5,318,824, to Itaya, et al., discloses a press-through package composed of a three-layer composite sheet, provided with a pocket, in which a layer of high density polyethylene (HDPE) is sandwiched between outer layers of a propylene polymer. A metal foil is bonded to the sheet to cover the pocket and enclose a tablet or capsule. The HDPE layer, provided for strength, transparency, moisture resistance, and rigidity, is 120–800 micrometers thick. Each of the outer layers, provided to aid in adhesion with the foil, contributes to the strength, makes up for the low vacuum and pressure formability and stretchability of the HDPE, while not affecting the transparency, and is 15–80 micrometers thick. The inner layer is at least 2.5 times as thick as each outer layer. To open the package, the tablet or capsule is pressed through the foil.

While many approaches have been taken to provide disposable containers for various products, some of which, as described above, satisfy a few of the needs in the art, but none are wholly satisfactory in all of these respects. Further, in contrast to many of the packages described above, which are designed to facilitate opening, it is also often paramount that the container contents not be easily accessible to children, for example, without being unduly burdensome for an adult to open.

Therefore, there is a need in the art for a disposable dispenser package for containing and dispensing materials such as hazardous, corrosive or caustic powders. There is also a need for such a container in which the material composition of the package contributes to the tear- and puncture-resistant nature thereof, as well as resisting degradation due to internal and external corrosive influences. There is a further need for a package with a preformed channel for dispensing the contained material from the package. There also is a need for a package with multiple compartments which separates hazardous, corrosive or caustic material, but allows simultaneous dispensing of these materials.

SUMMARY OF THE INVENTION

The present invention addresses the foregoing needs of the related art, by providing, in a first aspect, a dispenser package which includes a basin for containing certain materials and a spout for pouring the materials and which has a material composition to increase the tamper resistance and to reduce degradation due to internal and/or external corrosive effects.

An object of this invention is to address the foregoing needs in the art and to provide a disposable container which is particularly suited for containing single-use quantities of hazardous, corrosive or caustic granular materials.

A further object of this invention is to provide a child-resistant, disposable container for materials such as those that are hazardous, corrosive or caustic.

Another object of this invention is to provide a material composition for a disposable dispenser container for hazardous, caustic or corrosive materials, which contributes to the child-resistant nature of the container, while also resisting degradation due to internal and/or external corrosive influences.

Still a further object of this invention is to provide a disposable dispenser container for hazardous, corrosive or caustic materials with a preformed channel for dispensing the material.

Yet another object of this invention is to provide a disposable dispenser container for hazardous, caustic or corrosive materials, which has multiple compartments for separating the material but which allows simultaneous dispensing of the material.

In one aspect, the present invention relates to a dispenser package including a multilayered polymeric tray, including a basin and a brim. The tray is formed from a plastic structural layer and a bonding layer. A multilayered polymeric cover includes a cross-oriented, tear-resistant layer; a bonding layer; and a moisture-barrier layer between the tear-resistant layer and the bonding layer of the cover. The bonding layer of the cover is sealed to the bonding layer of the brim of the tray to form a closed cavity between the tray and the cover.

In another aspect, the present invention relates to a dispenser package including a multilayered polymeric tray including a basin and a spout extending from the basin, the basin and the spout terminating in a brim. The tray is formed of a plastic structural layer and a bonding layer. A multilayered polymeric cover includes (i) a tear-resistant layer comprising a laminate of plural layers of an oriented polymer, at least two of the plural layers being oriented in different directions, (ii) a bonding layer, and (iii) a moisture-barrier layer between the tear-resistant layer and the bonding layer of the cover. The bonding layer of the cover is sealed to the bonding layer of the brim of the tray to form a closed cavity between the tray and the cover.

In yet another aspect, the present invention relates to a single-use, disposable dispenser package, for containing hazardous, caustic or corrosive granular material, including a multilayered polymeric tray including a basin and a spout extending from the basin, the basin and the spout terminating in a brim. The tray is formed of (i) a structural layer comprising at least two coextruded layers of a blend of polypropylene and high-density polyethylene, and (ii) a bonding layer. A multilayered polymeric cover includes (i) a tear-resistant layer comprising a laminate of plural layers of oriented high-density polyethylene, at least two of the plural layers being oriented in different directions, (ii) a bonding layer, and (iii) a moisture-barrier layer between the tear-resistant layer and the bonding layer of the cover. The bonding layer of the cover is sealed to the bonding layer of the brim of the tray to form a closed cavity between the tray and the cover. The package is opened by cutting across the spout to create an opening through which the material contained in the package can be poured.

These and other objects, features and advantages will be more apparent from the discussion below with reference to the following drawings, in which like reference numerals denote like elements throughout.

DETAILED DESCRIPTION OF THE PREFERRED EMBODIMENTS

Figure 1A:
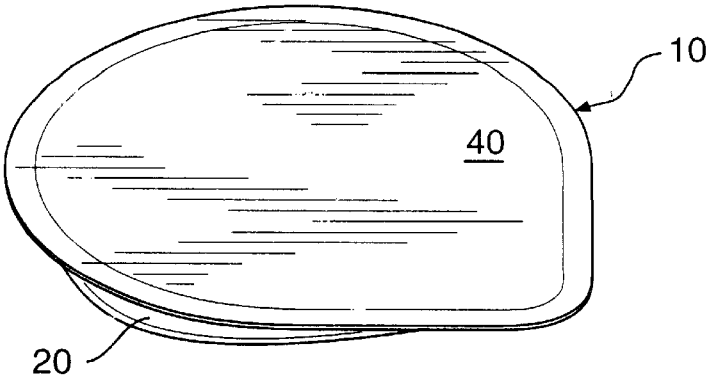
FIG. 1A is a perspective view of a dispenser package of an embodiment of the present invention.

FIG. 1A shows an embodiment of a dispenser package 10 of our invention, which is designed to hold granular materials, such as those that are hazardous, caustic or corrosive. The package 10 includes a thermoformed tray 20 and a cover 40 sealed to the tray 20.

Figure 1B:
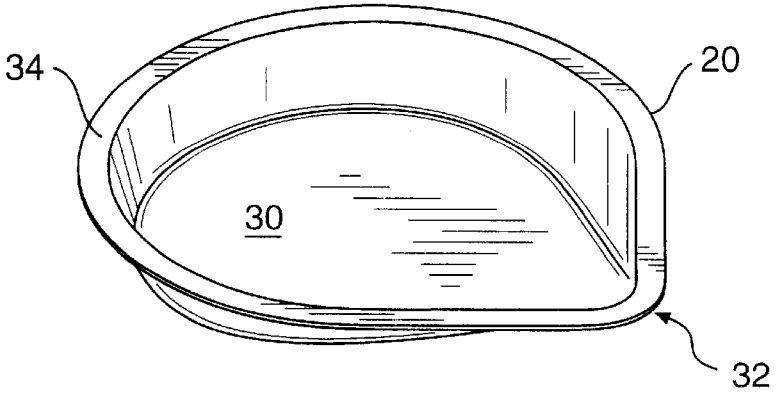
FIG. 1B is a perspective view of a tray of a dispenser package of an embodiment of the present invention.

FIG. 1B shows the tray 20 with the cover 40 removed. The tray 20 includes a basin 30 and a spout 32 extending from the basin 30. The basin 30 and the spout 32 terminate in a generally flat perimeter brim 34. In use, the basin 30 of the tray 20 is filled to a desired level with its intended contents and the cover 40 is sealed to the brim 34. In order to pour out the contents, we prefer that the package 10 be cut across the spout 32 with scissors or the like.

Figure 2A:
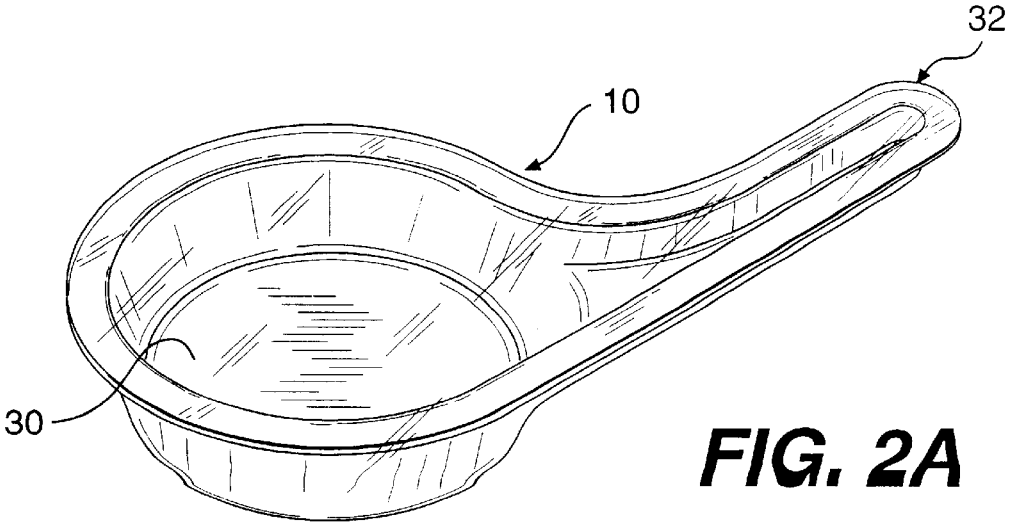
FIGS. 2A–2F are perspective views of alternate embodiments of a dispenser package of the present invention.
Figure 2B:
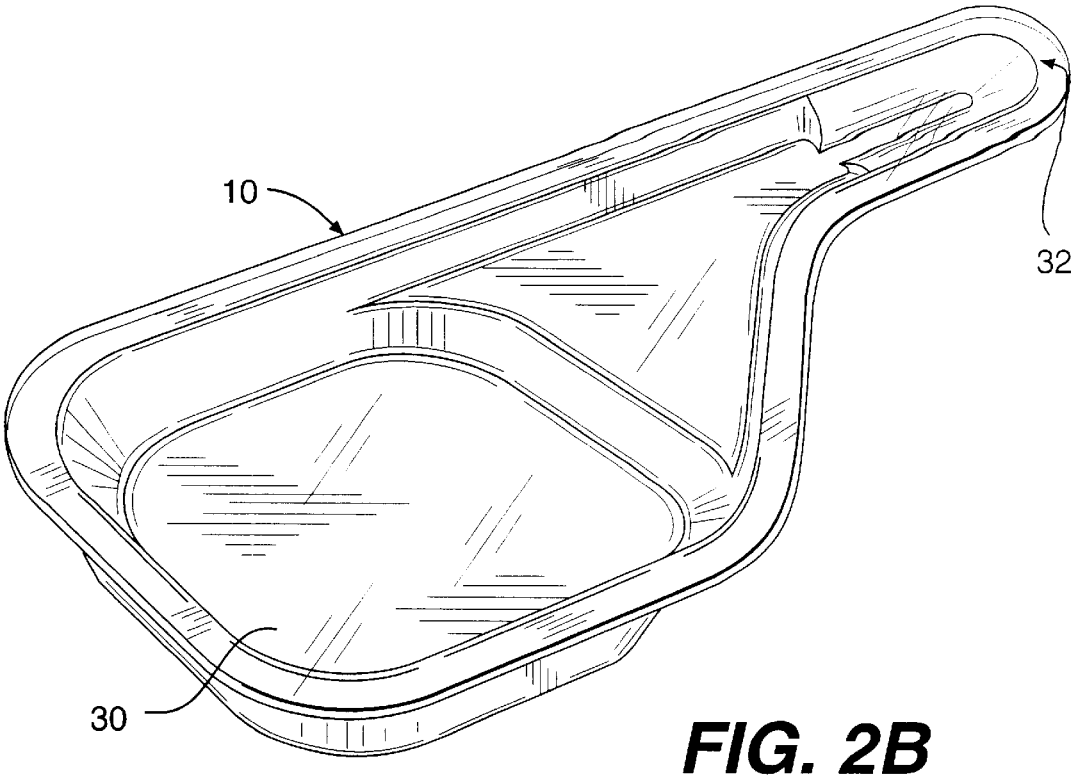
Figure 2C:
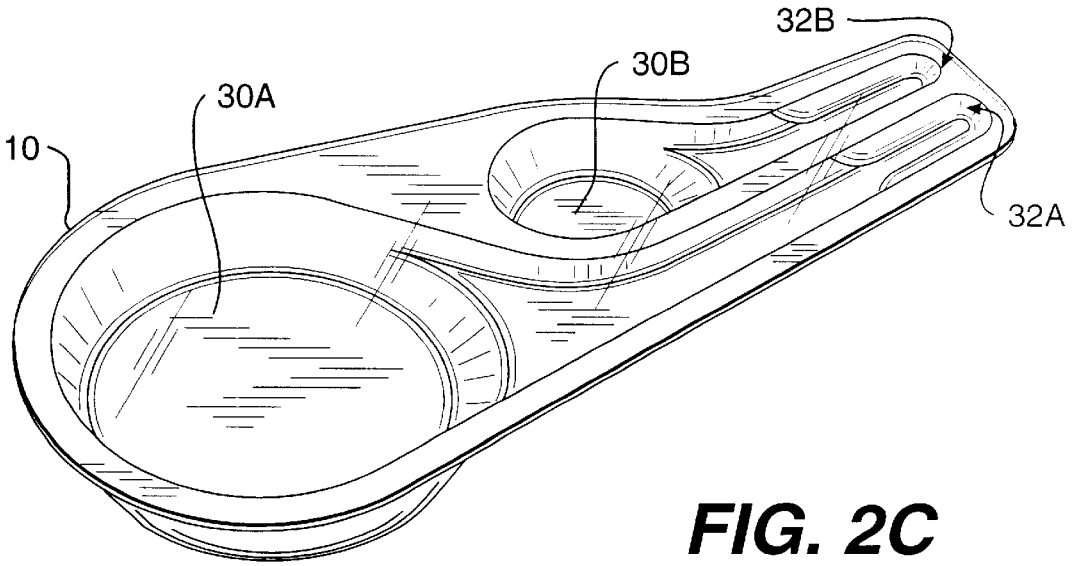
Figure 2D:
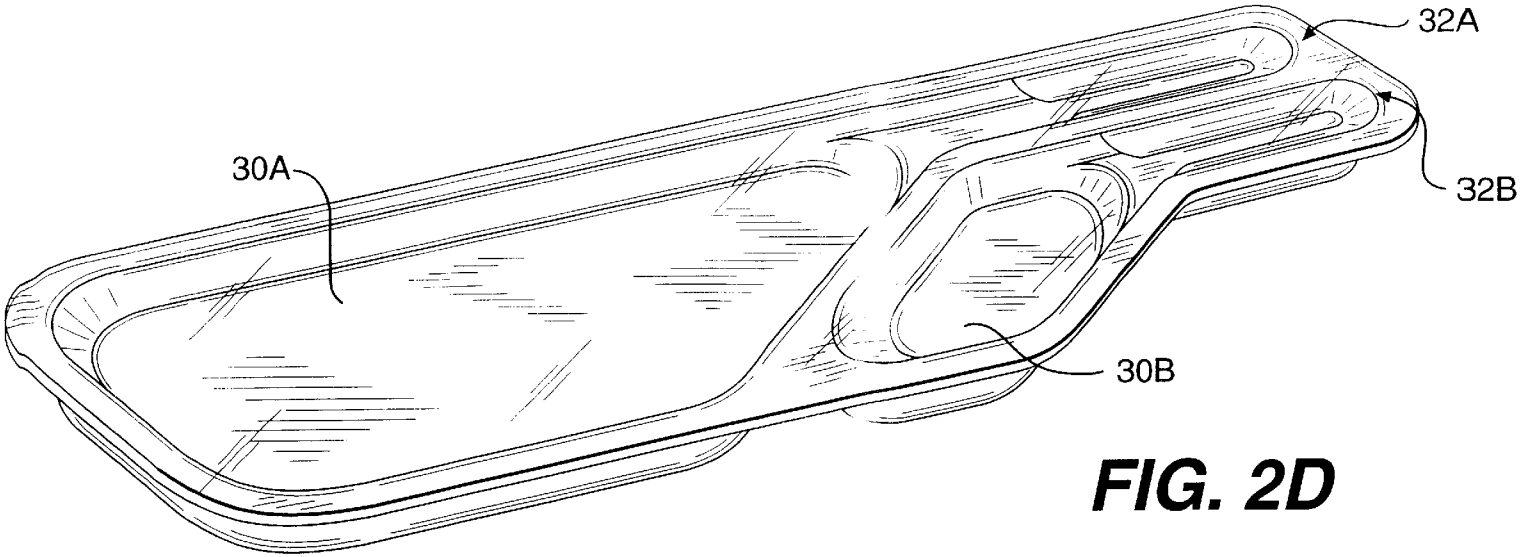
Figure 2F:
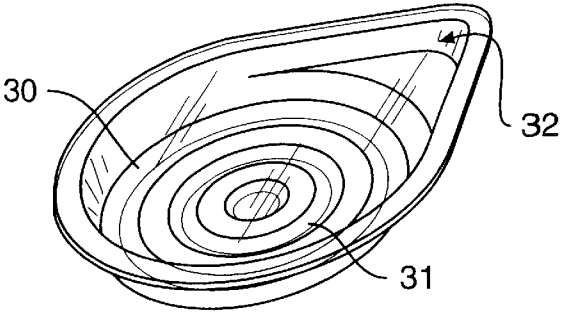
Figure 2E:
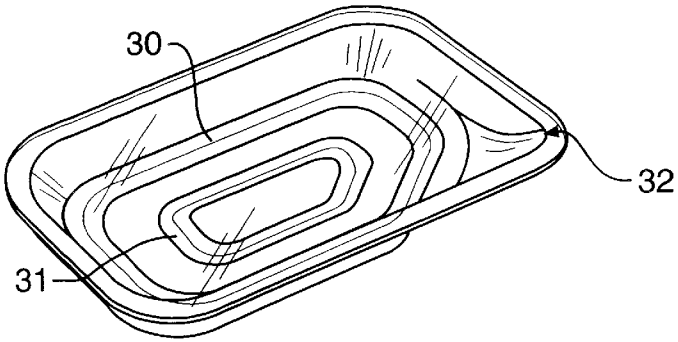

FIGS. 2A–2F show alternate embodiments of the package 10. The package of FIG. 2A, for example, has an elongated spout 32. The package 10 of FIG. 2B is similar to that shown in FIG. 2A, but has a generally square basin 30. The package 10 of FIG. 2C has dual basins 30A, 30B and corresponding spouts 32A, 32B. If desired, the basins 30A, 30B can hold separate materials, which are to be mixed upon use. In use, the package can be cut across both spouts 32A, 32B simultaneously, and the contents of both basins 30A, 30B poured out together. The package of FIG. 2D is similar to that shown in FIG. 2C, but with generally polygonal basins 30A, 30B. The package of FIG. 2E has a substantially rectangular basin 30 with a short spout 32 formed in one corner. Ridges 31 at the bottom of the basin provide structural stability. The package shown in FIG. 2F is similar to that shown in FIG. 2E, but with a generally round basin 30.

Figure 3A:
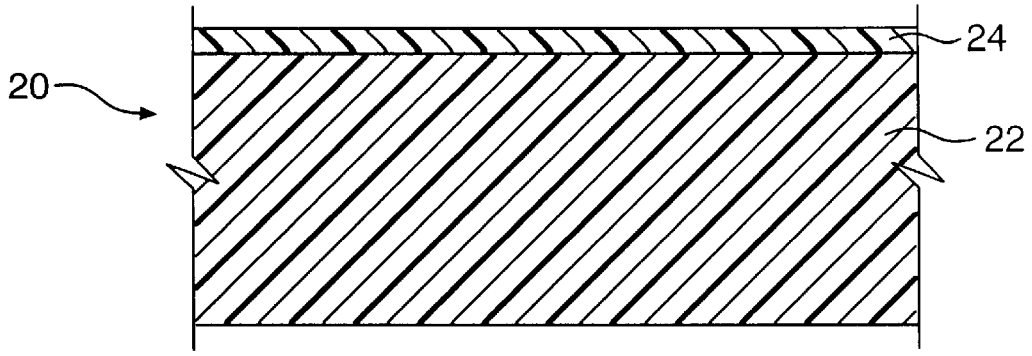
FIGS. 3A and 3B are partial cross sections of two embodiments of a multiple-layered material composition used in a tray of a dispenser package of the present invention.
Figure 3B:
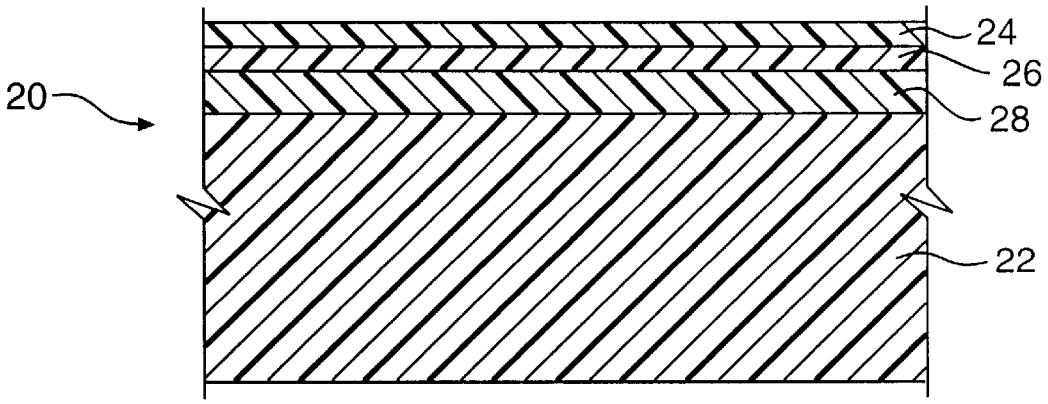

FIGS. 3A and 3B show partial cross sections of different embodiments of multiple-layer material compositions used in the tray 20, each revealing at least two polymeric layers, which will be discussed in more detail below. Both of these embodiments include a base structural layer 22 and a bonding layer 24. Depending upon the material chosen for the structural layer 22 and the intended contents of the package 10, an additional moisture barrier layer 26 can be provided, as shown in FIG. 3B, which can be attached to the structural layer 22 by an inner bonding layer 28. This moisture barrier layer 26 helps to inhibit degradation of the composition of the tray and the contents of the package due to moisture.

Each of the bonding layers 24, 28 can be formed of low density polyethylene (LDPE), linear low density polyethylene (LLDPE), an ionomer resin such as Surlyn® (commercially available from DuPont), or other such suitable material. LLDPE provides a high quality seal. Therefore, we prefer that the bonding layer 24 be formed of LLDPE, in order to provide a better seal with the cover. This contributes to the package's child-resistance by helping to prevent the cover 40 from being peeled from the tray 20 to expose the contents. The thickness of each of the bonding layers 24, 28 can vary depending upon the size of the package, but approximately 1.5 mils per layer is generally thick enough to serve the intended purpose.

The moisture barrier layer 26, present in the embodiment in FIG. 3B, is preferably formed of polyvinylidene chloride, which is commercially available from Dow Chemical as Saran®. Depending upon the shelf-life desired, the moisture barrier layer 26 can also be another vinyl material such as ethylene vinyl alcohol (EVOH), a foil, or other suitable material.

The thickness of the moisture barrier layer 26 may vary. By way of example, in the embodiment shown, the moisture barrier layer 26 is 1-mil Saran®. Therefore, the bonding layers 24, 28 and the moisture barrier layer 26 can be combined as a 4-mil thick coextrusion of 1-mil Saran® sandwiched between a 1.5-mil layer of LLDPE and a 1.5-mil layer of LDPE, which coextrusion is in turn bonded to the structural layer 22.

For packaging hazardous, caustic or corrosive consumer products, such as drain opener, it is desirable that the structural layer 22 be rugged, moisture resistant, and have a relatively long shelf life in potentially warm, humid environs. For production, we prefer that the structural layers be thermoformable.

The structural layer 22 is preferably formed of a coextrusion of multiple layers, each layer containing a blend of polypropylene (PP) and high density polyethylene (HDPE). Such a coextrusion of PP-HDPE blend layers is used in thick sheets for packaging perishable food items such as hams, and is available commercially from American National Can Company of Chicago, Ill. This coextrusion is available in combination with a 1.5-mil thick layer of LLDPE, as in the embodiment shown in FIG. 3A, from American National Can in a 25-mil thick coextrusion under the product designation "VX". This layered PP-HDPE blend is also available together with a 4-mil laminate of Saran® sandwiched between LDPE and LLDPE, as in the embodiment shown in FIG. 3B, in a 25-mil thick coextrusion from American National Can under the product designation "VY".

In another embodiment of the tray 20 of the present invention, the structural layer 22 can be formed of a rubber modified acrylonitrile copolymer. British Petroleum markets such a copolymer under the name Barex®, available in various grades, depending on the rubber content, of which 210 and 214 have proved to be workable in the present invention. Alternatively, any of a number of polyesters, polyethylene terephthalate (PET), recycled PET (RPET), virgin PET (VPET), a PET glycol copolymer (PETG), poly 1,4 cyclohexylene dimethylene terephthalate copolymer (PCTG), a coextrusion of RPET and PETG, a coextrusion of RPET and PCTG, or the like, can be used. However, many of these materials age and get brittle more rapidly in warm, humid climates than is commercially desirable with a consumer product which contains potentially hazardous, caustic or corrosive materials. Also available are straight coextrusions of polypropylene and high density polyethylene. However, at present, these are commercially undesirable, due to their high cost.

Figure 4:
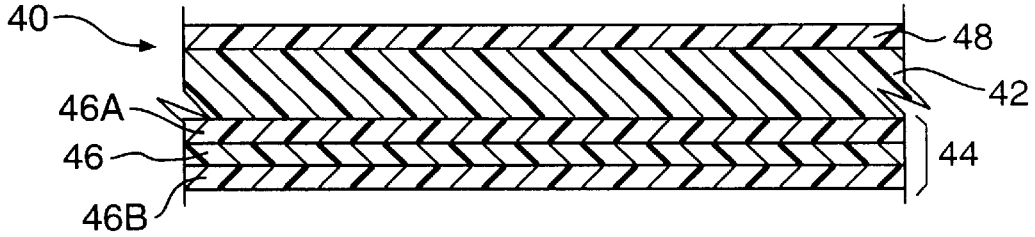
FIG. 4 is a partial cross section of an embodiment of a multiple-layered material composition used in a cover of a child-resistant package of the present invention.

FIG. 4 shows a partial cross section of a multiple-layered material composition of an embodiment of the cover 40 of the package 10 of the present invention. In the preferred embodiment, the cover includes three primary layers. A core layer 42 is the primary structural layer and provides tear resistance. An inner layer 44, shown here as a three-layer laminate, provides moisture resistance as well as a sealing surface to attach the cover 40 to the tray 20. An outer layer 48 can be provided to increase the puncture resistance of the cover 40 as well as to provide a protective coating under which reverse printing can be performed.

The core layer 42 is formed of multiple layers of a thermoplastic sheet or film material which is molecularly oriented by any manner known in the art. U.S. Pat. No. 4,838,429, to Fabisiewicz, and U.S. Pat. No. 3,608,815, to Bunch, for example, describe molecularly-oriented materials such as PP, polyethylene and polystyrene, oriented by methods such as stretching in a predetermined direction. The layers of the core layer 42 are oriented in different directions ("cross-oriented"), which enhances the tear resistance of the material. Any number of cross-oriented polymers can be used. Oriented polymers, when cross-laminated, are highly resistant to tearing. The thickness of this layer 42 will vary depending on the size of the package 10.

We prefer that the core layer 42 be formed of a cross-laminated structure of oriented HDPE. Van Leer Flexibles, Inc., of Houston, Tex., markets a suitable laminate structure under the name Valeron®. Valeron® is available in various gauges. By way of example, in the embodiment shown in FIG. 4, the core layer 42 is a 3-mil thick layer of Valeron®. At this thickness, the core layer 42 has an average approximate break strength (machine and transverse directions) of 7500 p.s.i. (ASTM D-882), a minimum approximate Toyo impact strength of 95 kg-cm (ASTM D-781/spherical head), a minimum approximate puncture propagation/tear resistance of 2200 gms (ASTM D-2582), and an approximate yield of 14 lbs/msf. The 3-mil Valeron® resists puncture sufficiently in testing under the protocol established by the Consumer Product Safety Commission under authority of the Poison Prevention Packaging Act.

Valeron® has an operating temperature range of approximately −70° to 200° F. However, 3-mil Valeron® does not exhibit sufficient moisture resistance to be used alone in the cover 20, having a water vapor transmission rate at 100° F. and 90% relative humidity of approximately 0.15 gm/100 $in^2$/24 hrs (ASTM E-96, method E). Therefore, we prefer that the cover 20 also contain a component in the inner layer 44 to augment moisture resistance.

In the embodiment shown in FIG. 4, the inner layer 44 is a coextrusion made up of a polymer film 46 sandwiched between layers of LLDPE 46A, 46B. The polymer film 46 can be EVOH, and serves as a moisture barrier which prevents degradation of the composition of the cover and the contents of the package due to moisture. Alternatively, Saran® or another suitable material can be used. The layers of LLDPE 46A, 46B are provided for bonding the coextrusion 44 to the core layer 42 and bonding the cover 40 the tray 20. LDPE, Surlyn®, and other suitable materials can be used. We prefer that layer 46B be LLDPE, to provide a quality seal between the cover 40 and the tray 20. The thickness of the various layers of the coextrusion 44 will vary, depending on the size of the package. By way of example, in the embodiment shown in FIG. 4, the coextrusion 44 is 4 mils thick, comprising a 1-mil thick layer of EVOH sandwiched between two 1.5-mil thick layers of LLDPE.

The outer layer 48, which is preferably formed of PET, can be provided to enhance the puncture resistance of the cover 40 and to provide a protective surface under which graphics can be reverse printed. In the embodiment shown in FIG. 4, the outer layer 48 is 92-gauge PET.

The cover 40 can be formed by any of a number of conventional methods, such as a simultaneous extrusion method in which the outer layer 48 and the core layer 42 can be brought together and pressed with the various layers of the coextruded inner layer 44 as it is coextruded. Alternatively, the inner layer 44 could be separately coextruded, and then the separately formed outer layer 48 and the core layer 42 could be laminated thereon. The structure of the tray 20 can be thermoformed by conventional means, filled to the desired level with the desired contents, and then the cover 40 can be heat sealed thereto.

As discussed earlier, it is desirable for a packaged consumer product to have a relatively long shelf life. The shelf life can be predicted by testing the package's permeation rate, which is generally linear, in controlled conditions. Once the rate is determined under these conditions, the characteristics of the package in likely operating conditions can be determined by extrapolation from psychrometric charts.

For example, tests performed on the embodiment of the package using the tray shown in FIG. 3B, and the cover shown in FIG. 4, as discussed above, indicate a shelf life of the package containing, for example, powdered drain opener to be approximately 13 months at 90° F. and 90% relative humidity. This extrapolates to an actual projected shelf life of over 2 years, even in the harshest climates in the United States, where the average conditions are 76° F. at 75% humidity.

While the dispenser package of the present invention is particularly suited for use with hazardous, caustic or corrosive granular materials, other materials can be stored therein. The package provides a secure container which resists degradation and is suitable for use with granular, liquid or gelatinous items such as food, personal hygiene, cosmetic or cleaning products. Further, while the package is designed to be cut open across a pouring spout to access the contents, other ways to open or assist in opening the package can be provided. As will be appreciated by those of ordinary skill in the art, the package can be, for example, scored to provide a tear-away corner. Alternatively, the package can be provided with a resealable opening.

While the present invention has been described with respect to what is at present considered to be the preferred embodiments, it is to be understood that the invention is not limited to the disclosed embodiments. To the contrary, the invention is intended to cover various modifications and equivalent arrangements included within the spirit and scope of the appended claims. Therefore, the scope of the following claims is intended to be accorded the broadest reasonable interpretation so as to encompass all such modifications and equivalent structures and functions.

Industrial Applicability

A package according to the present invention is particularly applicable to hazardous, caustic or corrosive, powdered consumer products which are suited to single-dose packaging. Granular drain cleaners or bleach are examples of such materials. The package is durable and tough, and protects the contents against degradation due to environmental factors, as well as against access by children. When needed, the package is simple for an adult to open with the aid of a pair of scissors, for example. The package can also be adapted for use with other items, such as food, personal hygiene, cosmetic, and cleaning products.

We claim:

1. A dispenser package comprising:

a multilayered polymeric tray, including a basin and a brim, the tray being formed from a plastic structural layer and a bonding layer; and a multilayered polymeric cover including a cross-oriented, tear-resistant layer, a bonding layer, and a moisture-barrier layer between the tear-resistant layer and the bonding layer of the cover, the bonding layer of the cover being sealed to the bonding layer of the brim of the tray to form a closed cavity between the tray and the cover.

2. The dispenser package of claim 1, wherein the tray further includes a spout extending from the basin, the basin and the spout terminating in the brim.

3. The dispenser package of claim 1, wherein the tray further comprises a moisture-barrier layer between the structural layer and the bonding layer of the tray.

4. The dispenser package of claim 1, wherein the cover further comprises an inner bonding layer disposed between the moisture-barrier layer of the cover and the tear-resistant layer.

5. The dispenser package of claim 3, wherein the structural layer of the tray is formed of a material selected from the group consisting of high-density polyethylene, polypropylene, a blend of polypropylene and high-density polyethylene, a rubber modified acrylonitrile copolymer, a polyester, polyethylene terephthalate, virgin polyethylene terephthalate, recycled polyethylene terephthalate, a polyethylene terephthalate glycol copolymer, and a poly 1,4 cyclohexylene dimethylene terephthalate copolymer.

6. The dispenser package of claim 5, wherein the structural layer of the tray is formed of a coextrusion of multiple layers.

7. The dispenser package of claim 1, wherein the structural layer of the tray is comprised of high-density polyethylene.

8. The dispenser package of claim 1, wherein the structural layer of the tray is comprised of polypropylene.

9. The dispenser package of claim 1, wherein the structural layer of the tray is comprised of a blend of polypropylene and high-density polyethylene.

10. The dispenser package of claim 1, wherein the structural layer of the tray is comprised of a coextrusion of plural layers, at least two of the plural layers comprising a blend of polypropylene and high-density polyethylene.

11. The dispenser package of claim 1, wherein the structural layer of the tray is comprised of a rubber modified acrylonitrile copolymer.

12. The dispenser package of claim 1, wherein the tear-resistant layer of the cover comprises a laminate of plural layers of an oriented polymer, at least two of the plural layers being oriented in different directions.

13. The dispenser package of claim 12, wherein the oriented polymer comprises high-density polyethylene.

14. The dispenser package of claim 1, wherein the cover further comprises an outer layer on which graphics are reverse printed.

15. The dispenser package of claim 14, wherein the outer layer comprises polyethylene terephthalate.

16. A dispenser package comprising:

a multilayered polymeric tray including a basin and a spout extending from the basin, the basin and the spout terminating in a brim, the tray being formed of a plastic structural layer and a bonding layer; and a multilayered polymeric cover including (i) a tear-resistant layer comprising a laminate of plural layers of an oriented polymer, at least two of the plural layers being oriented in different directions, (ii) a bonding layer, and (iii) a moisture-barrier layer between the tear-resistant layer and the bonding layer of the cover, the bonding layer of the cover being sealed to the bonding layer of the brim of the tray to form a closed cavity between the tray and the cover.

17. The dispenser package of claim 16, wherein the tray further comprises a moisture-barrier layer between the structural layer and the bonding layer of the tray, and an inner bonding layer disposed between the moisture-barrier layer of the cover and the tear-resistant layer.

18. The dispenser package of claim 16, wherein the oriented polymer comprises high-density polyethylene.

19. The dispenser package of claim 16, wherein the structural layer of the tray is comprised of a coextrusion of plural layers, at least two of the plural layers each comprising at least one of polypropylene and high-density polyethylene.

20. The dispenser package of claim 19, wherein the at least two layers each comprises a blend of polypropylene and high-density polyethylene.

21. A single-use, disposable dispenser package, for containing hazardous, caustic or corrosive granular material, comprising:

a multilayered polymeric tray including a basin and a spout extending from the basin, the basin and the spout terminating in a brim, the tray being formed of (i) a structural layer comprising at least two coextruded layers of a blend of polypropylene and high-density polyethylene, and (ii) a bonding layer; and a multilayered polymeric cover including (i) a tear-resistant layer comprising a laminate of plural layers of oriented high-density polyethylene, at least two of the plural layers being oriented in different directions, (ii) a bonding layer, and (iii) a moisture-barrier layer between the tear-resistant layer and the bonding layer of the cover, the bonding layer of the cover being sealed to the bonding layer of the brim of the tray to form a closed cavity between the tray and the cover, wherein the spout is shaped so that removal of a tip thereof by cutting creates an opening through which the material contained in the package can be poured.

* * * * *